US009646733B2

(12) United States Patent
Shelton et al.

(10) Patent No.: US 9,646,733 B2
(45) Date of Patent: May 9, 2017

(54) TRACER WIRE PRODUCT AND METHOD OF MANUFACTURE OF THE SAME

(71) Applicant: NEPTCO, INC., Pawtucket, RI (US)

(72) Inventors: Larry Shelton, Coventry, RI (US); Patrick Tiberio, Mansfield, MA (US); Robert F. Hegan, Canterbury, CT (US)

(73) Assignee: NEPTCO, INC., Pawtucket, RI (US)

( * ) Notice: Subject to any disclaimer, the term of this patent is extended or adjusted under 35 U.S.C. 154(b) by 3 days.

(21) Appl. No.: 14/629,566

(22) Filed: Feb. 24, 2015

(65) Prior Publication Data

US 2016/0247605 A1 Aug. 25, 2016

(51) Int. Cl.

| | |
|---|---|
| ***H01B 7/00*** | (2006.01) |
| ***H01B 1/02*** | (2006.01) |
| ***H01B 3/44*** | (2006.01) |
| *H01B 13/26* | (2006.01) |

(52) U.S. Cl.

CPC ..... *H01B 1/02* (2013.01); *H01B 3/441* (2013.01); *H01B 13/2613* (2013.01)

(58) Field of Classification Search

CPC ..... H01B 7/0208
USPC ..... 174/117 M, 120 R
See application file for complete search history.

(56) References Cited

U.S. PATENT DOCUMENTS

| | | | | |
|---|---|---|---|---|
| 5,949,018 A * | 9/1999 | Esker | H01B 7/288 | 174/106 R |
| 7,932,469 B1 * | 4/2011 | Shelton | F16L 11/02 | 174/117 M |
| 9,054,504 B2 * | 6/2015 | Shelton | F16L 11/02 | |

* cited by examiner

*Primary Examiner* — Chau N Nguyen
(74) *Attorney, Agent, or Firm* — ISUS Intellectual Property PLL

(57) ABSTRACT

A tracer wire product for use in detection of underground utility line or routes includes: a metallic wire configured to conduct an electrical signal for detection by an aboveground signal detector; a tin coating formed over the metallic wire; a non-fibrous insulating jacket of polyethylene over the tin coating; a hot melt adhesive at least partially over the polyethylene jacket; a high tenacity woven polyester strength element with water blocking fibers being formed over the hot melt adhesive and the polyethylene jacket; and, an abrasion resistant HDPE outer jacket formed over the high tenacity woven polyester strength element to form one of a circular or oval cross-sectional shape. Further, an apparatus and method for manufacturing the tracer wire product includes a source of a substantially flat polyester woven material; a source of a metal wire material; and an elongated forming tool including an input base into which the substantially flat polyester woven material is fed. The elongated forming tool also includes an outlet member downstream of the input base and including a restricted passage for receiving the metal wire material, and concurrently folding the substantially flat polyester woven material about the metal wire material.

3 Claims, 7 Drawing Sheets

TRACER WIRE PRODUCT AND METHOD OF MANUFACTURE OF THE SAME

FIELD OF THE INVENTION

The present invention relates in general to a tracer wire product that is used for underground detection applications and machinery useful in manufacturing the same.

BACKGROUND OF THE INVENTION

A prior art patent in the general field is U.S. Pat. No. 7,932,469 to Shelton et al. Reference may be made to this patent in connection with a general background discussion pertaining to direct-buried cables and the use of a tracer cable for the reliable detection of the placement and location of direct-buried cables as well as the placement and location of other utility delivery cables. The entirety of U.S. Pat. No. 7,932,469, owned by the assignees of the present invention, is herein incorporated by reference in its entirety. The product described in the '469 patent is somewhat complicated to produce and, accordingly, it is an object of the present invention to provide an improved tracer wire product that can be manufactured relatively easily and economically.

Another object of the present invention is to provide a tracer wire product that has superior strength, that is resistant to impact or other forces, and that is constructed to provide very precise dimensional control, preferably at +1-3%.

Still another object of the present invention is to provide an improved tracer wire product that has wide applicability in connection with the detection and the location of underground cables, pipes and other lines.

SUMMARY OF THE INVENTION

To accomplish the foregoing and other objects, features and advantages of the present invention there is provided a tracer wire product as well as an apparatus for manufacturing, a tracer wire product, and that is comprised of a source of a substantially flat polyester woven material; a source of a metal wire material; and an elongated forming tool including an input base into which the substantially flat polyester woven material is fed. The elongated forming tool also including an outlet member downstream of the input base and including a restricted passage for receiving the metal wire material, and concurrently folding the substantially flat polyester woven material about the metal wire material.

In accordance with other aspects of the present invention the input base includes a substantially flat base upon which the substantially flat polyester woven material rests, and the outlet member comprises a circular tubular piece so that as the substantially flat polyester woven material progresses therethrough, it is folded about the metal wire material; the metal wire material is fed into the fold so that the metal wire material is encased in the folded polyester woven material; including a hot melt device for receiving the metal wire material and applying an adhesive to the metal wire material prior to it being folded over by the polyester woven material; the hot melt device includes an input tube for receiving the metal wire material; including means for providing a uniform cover over the folded polyester woven material and metal wire material; including a guide tube downstream of said forming tool for capturing the folded product; the means for providing a uniform cover includes an extruder, with the guide tube extending into an extruder member; including means for providing a uniform cover over the folded polyester woven material and metal wire material, and a guide tube downstream of the forming tool for capturing the folded product, the means for providing a uniform cover including an extruder, with the guide tube extending into an extruder member; including a second forming tool downstream of said elongated forming tool for forming the product into an oval shape; including a take-up device for storing the folded and covered product.

In accordance with another embodiment of the present invention there is provided a system for fabricating a tracer wire product, and that is comprised of a first source station for storing a continuous length of a substantially flat polyester woven material; a second source station for storing a continuous length of a metal wire material; a third station at which the materials are formed into a circular product and comprised of an elongated forming tool including an input base into which the substantially flat polyester woven material is fed, and an outlet member downstream of the input base and including a restricted passage for receiving the metal wire material, and concurrently folding the substantially flat polyester woven material about the metal wire material to form the circular product.

In accordance with still other aspects of the present invention the input base includes a substantially flat base upon which the substantially flat polyester woven material rests, and the outlet member comprises a circular tubular piece so that as the substantially flat polyester woven material progresses therethrough, it is folded about the metal wire material; including a hot melt device for receiving said metal wire material and applying an adhesive to the metal wire material prior to it being folded over by the polyester woven material polyester woven material; including means for providing a uniform cover over the folded polyester woven material and metal wire material, arid a guide tube downstream of the forming tool for capturing the folded product; including means for providing a uniform cover over the folded polyester woven material and metal wire material, and a guide tube downstream of the forming tool for capturing the folded product, said means for providing a uniform cover including an extruder, with the guide tube extending into an extruder member; and including a second forming tool downstream of the elongated forming tool for forming the product into an oval shape.

Another version of the present invention relates to a method for fabricating a tracer wire product, comprising: providing a continuous length of a substantially flat polyester woven material; providing a continuous length of a metal wire material; forming into a circular product the substantially flat polyester woven material by feeding it through a restricted passage for receiving said metal wire material, and concurrently folding said substantially flat polyester woven material about the metal wire material to form the circular product. Other aspects are including applying an adhesive to said metal wire material prior to it being folded over by the polyester woven material; and including providing a uniform cover over the folded polyester woven material and metal wire material, and a guide tube downstream of the forming tool for capturing the folded product.

In another aspect, a method for fabricating a tracer wire product includes providing a length of a substantially flat polyester woven material the material including a high tenacity polyester strength element further comprising water blocking yarns; providing a length of a metal wire material, the metal wire material being tin plated and covered by a polyethylene jacket, the polyethylene jacket at least partly covered by a hot melt adhesive; forming into a circular product the substantially flat polyester woven material by feeding it through a restricted passage for receiving said metal wire material, and concurrently folding said substantially flat polyester woven material about said metal wire material to form said circular product; and, coating the circular product with an abrasion resistant HDPE outer jacket.

In an aspect, the method further includes the steps of treating the circular product with one or more dies to reform the product into an oval shape and applying an adhesive to said polyethylene jacket prior to it being folded over by said polyester woven material.

In a further aspect, a detectable tracer element for use in detection of underground utility line or routes includes a metallic wire configured to conduct an electrical signal for detection by an aboveground signal detector; a tin coating formed over the metallic wire; a non-fibrous insulating jacket of polyethylene over the tin coating; a hot metal adhesive applied to at least a portion of the polyethylene jacket; a high tenacity woven polyester strength element with water blocking fibers being formed over the hot melt adhesive and the non-fibrous insulating jacket; and, an abrasion resistant HDPE outer jacket formed over the high tenacity woven polyester strength element to form one of a circular or oval cross-sectional shape.

In yet a further aspect, the metallic wire is Cu-based and has a size of about 19 AWG and the tracer element has a breaking strength of about 1800 lbs. The non-fibrous polyethylene coating is about 0.005" in thickness and the HDPE coating is about 0.030" in thickness. The hot melt adhesive may be selected a number of sources, including Hot Melt Technologies, Inc., 1723 W. Hamlin Road, Rochester Hills, Mich. 48309, Part No. 1266-P. This hot melt adhesive comprises: ethylene vinyl acetate copolymer, pentaerythratol rosin ester, C9/C5 hydrocarbon tackifying resin and an antioxidant.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

In accordance with one aspect of the present invention, there is provided an apparatus for manufacturing a tracer wire product. The apparatus is comprised of a source of a substantially flat woven material along with a source of a metal wire material which may be insulation coated. In accordance with the apparatus there is provided an elongated forming tool including an input base into which the substantially flat woven material is fed. The elongated forming tool also includes an outlet member downstream of the input base defining a restricted passage for receiving the metal wire material, and concurrently folding the flat woven material about the metal wire material to form a more circular product.

Figure 1:
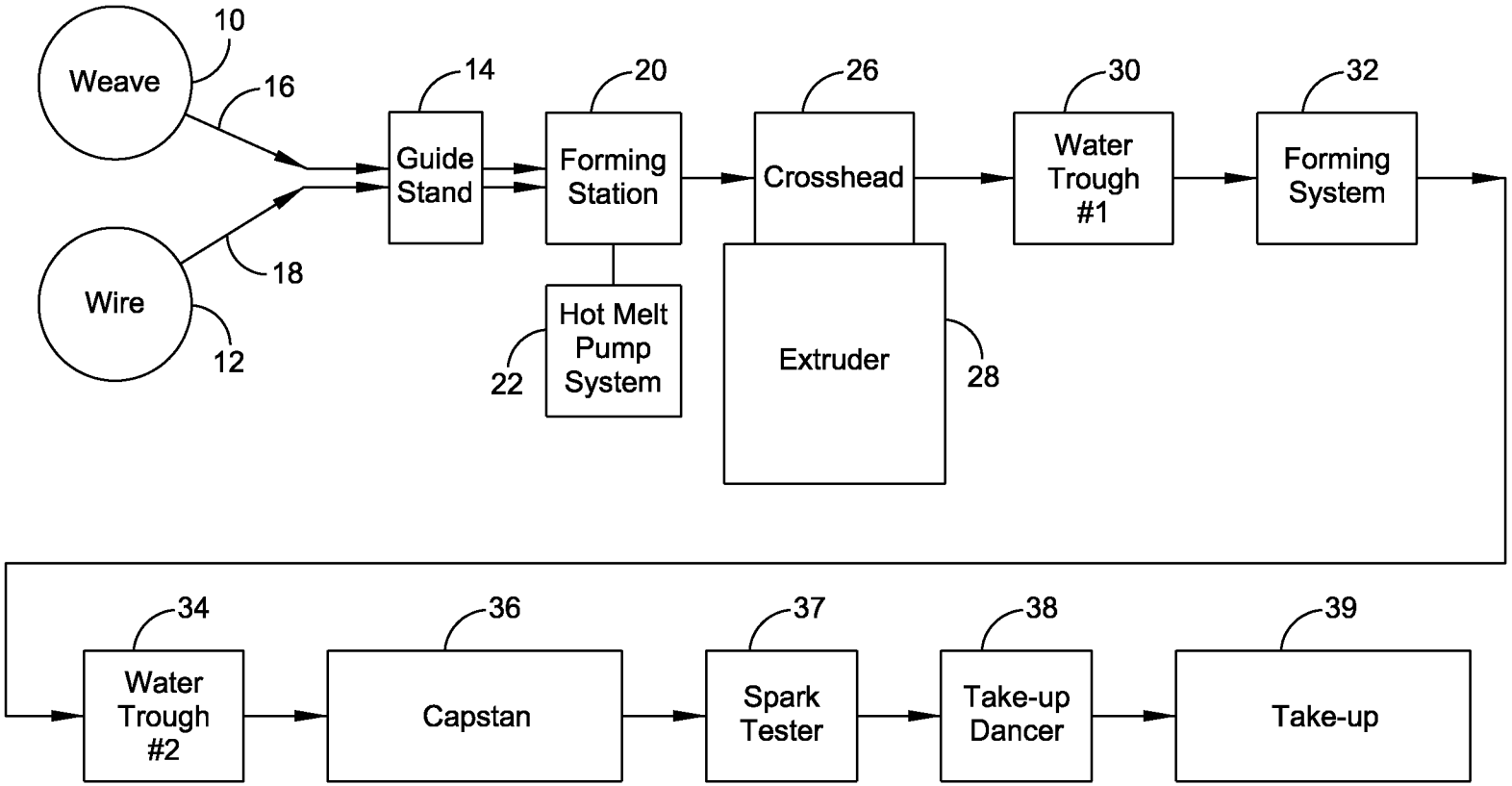
FIG. 1 is a block diagram illustrating the system and associated method of the present invention.
Figure 2:
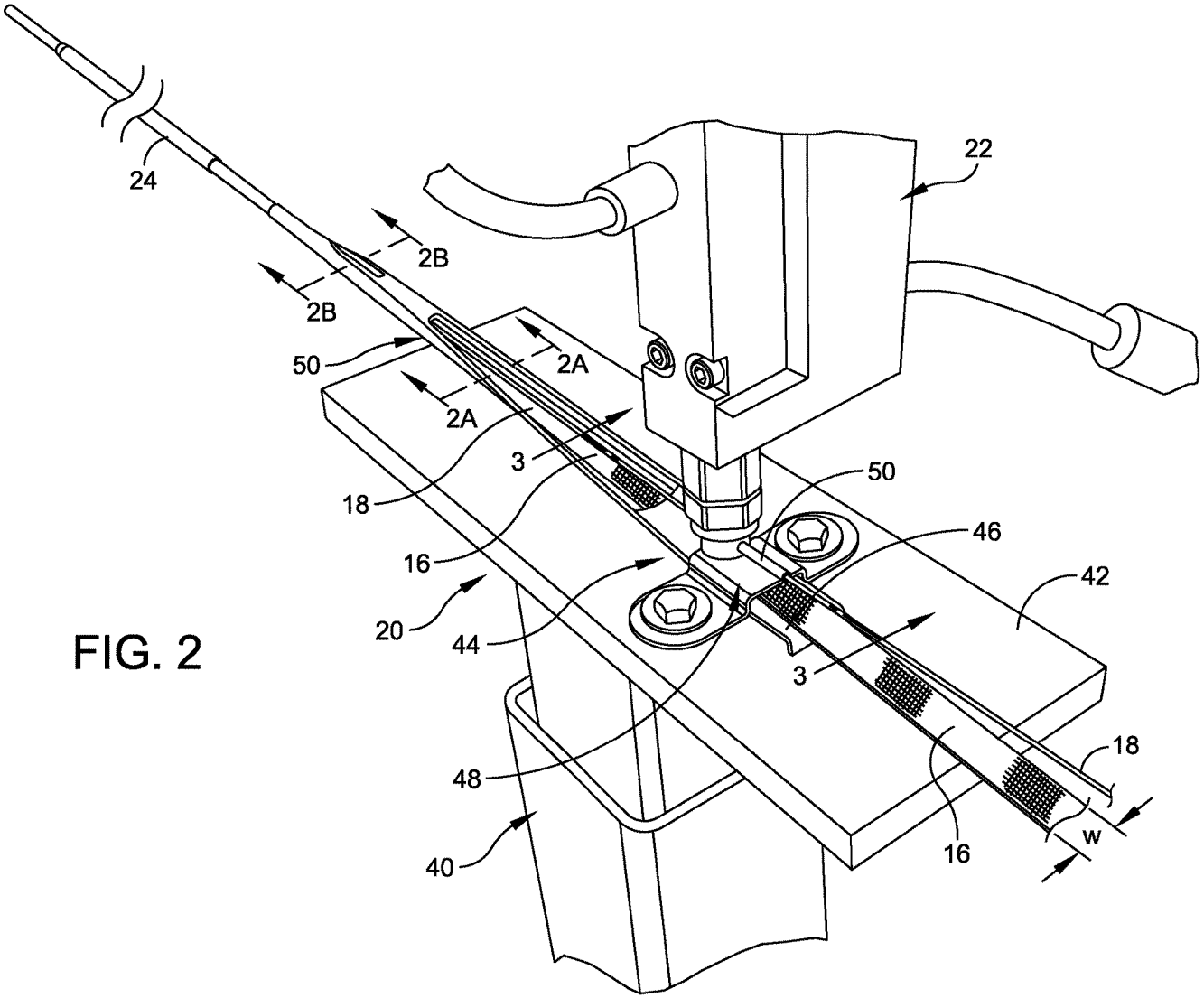
FIG. 2 is a perspective view of a portion of the system illustrated in FIG. 1 and, in particular, at the forming apparatus.
Figure 3:
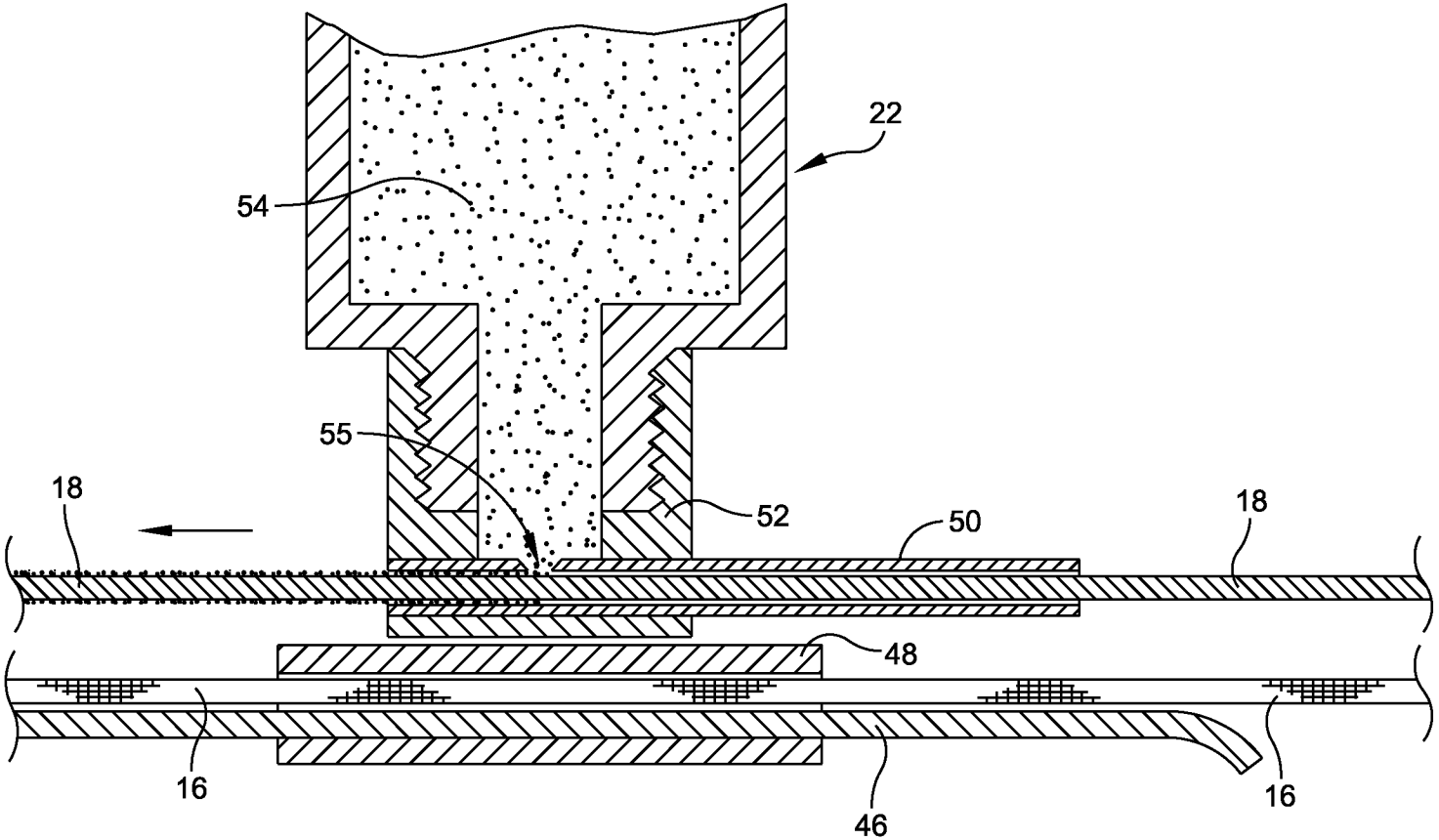
FIG. 3 is a cross-sectional view taken along line 3-3 of FIG. 2.
Figure 4:
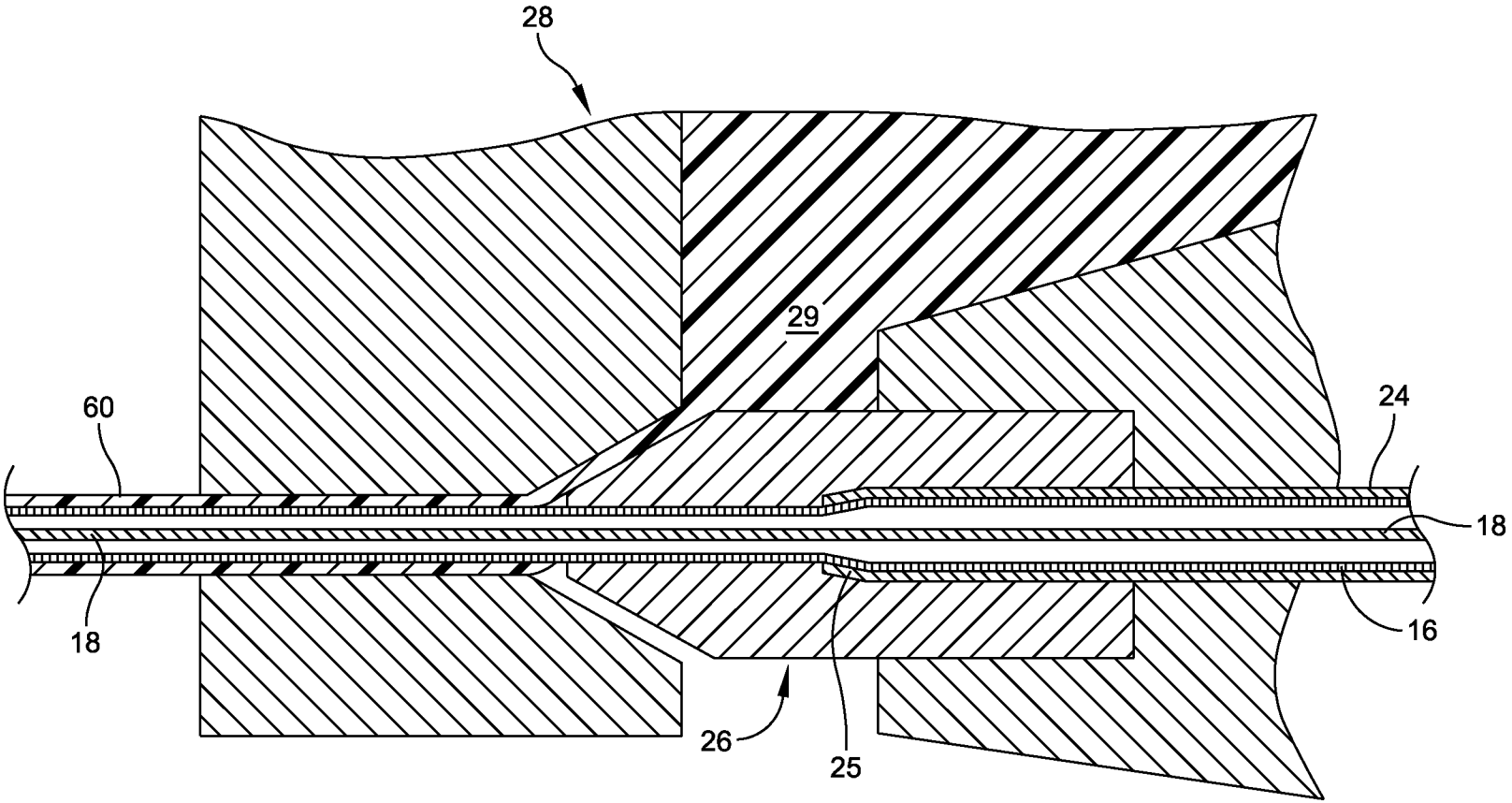
FIG. 4 is a further cross-sectional view taken at the extruder location.
Figure 5:
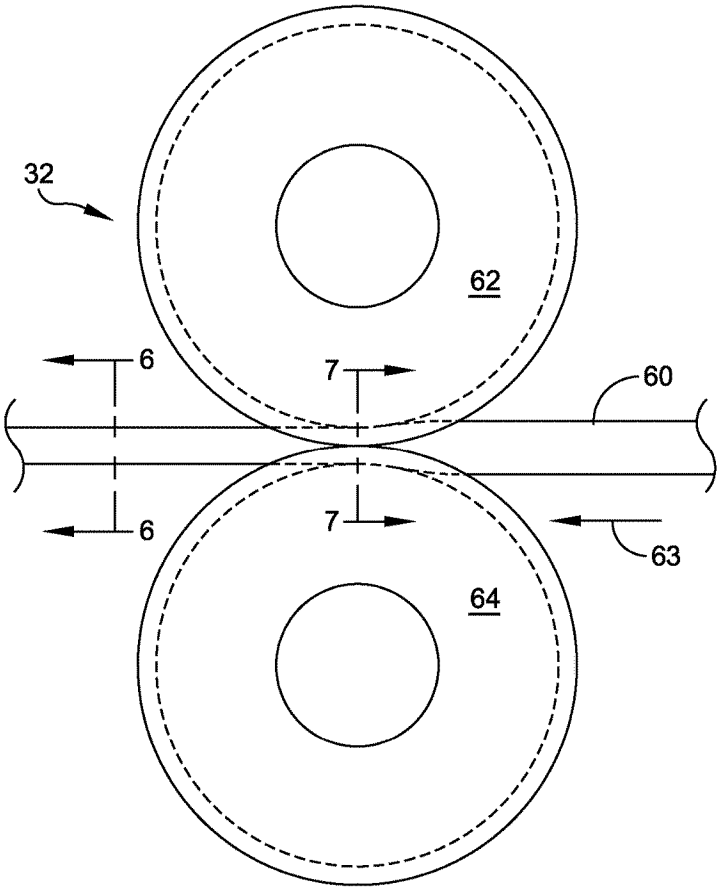
FIG. 5 is a further detailed view of a further forming arrangement for shaping the cable.

FIG. 1 of the drawings is an illustration in block diagram form of a system used in producing the tracer wire product of the present invention. FIGS. 2 and 3-7 describe further details of mechanisms used in the manufacturing of the product of FIGS. 2A, 2B and 6. FIG. 2 illustrates the basic forming station wherein the woven material is formed about the Wire element, best seen with respect to FIGS. 2A and 2B. FIG. 3 further illustrates the use of a hot melt adhesive about the wire. FIG. 4 illustrates the extrusion process wherein a cover or sleeve is formed about the product to form the final outer layer of the product. FIG. 5 illustrates a further forming system for transforming the product into a preferred oval shape as illustrated in the cross-sectional view of FIG. 6, or other rounded shapes.

With further reference to the block diagram of FIG. I, a pair of payoff devices at the beginning of the process are illustrated as woven material payoff 10 and wire payoff 12. Both of these payoffs may be in the form of a spool that contains either the woven material or the wire for delivery to a guide stand 14. The guide stand 14 may be considered as a conventional device that simply and separately guides the woven material 16 and wire 18. From the guide stand 14 the woven material and wire are directed to forming station 20. Also illustrated in FIG. 1 is a hot melt pump system 22 that is adapted to deliver a small amount of adhesive material to the wire as described hereinafter in the cross-sectional view of FIG. 3.

After the woven material has been formed about the wire, a guide tube 24 (see FIGS. 2 and 4) guides the product to a crosshead 26 associated with extruder 28. In this regard reference may also be made to FIG. 4 that provides somewhat more detail of the crosshead 26 and extruder 28.

With further reference to the block diagram of FIG. 1, the product then advances to a first water trough 30 for initial cooling of the product and from there to a further forming system 32.

In connection with the forming system 32, reference will be made hereinafter to FIGS. 5-7.

From the forming system 32, the product progresses to a second water trough 34 and from there to a capstan 36 that maintains a pulling drive for the product being manufactured. FIG. 1 also illustrates in the block diagram a spark tester 37, a take-up dancer 38 and a final take-up 39 upon which the completed the product is stored. The final take-up 39 may be a spool.

Some of the components described in the block diagram of FIG. 1 are considered to be conventional and thus need not be shown in detail. This may include, for example, water troughs 30 and 34 and other components downstream of the water trough 34.

Reference is now made to the perspective view of FIG. 2 which shows the forming station 20 as well as the hot melt pump system 22. The forming station 20 may include some type of a pedestal 40 that, in turn, supports a base plate 42. Secured to the base plate 42 is the forming tool 44 of the present invention. The forming tool 44 includes an input base 46 upon which the flat polyester woven material 16 rests. The perspective view of FIG. 2 illustrates the woven material 16 in its flat condition progressing over the base 46. FIG. 2 also illustrates an overlying member 48 that also assists in guiding the flat woven material 16.

Figure 2B:
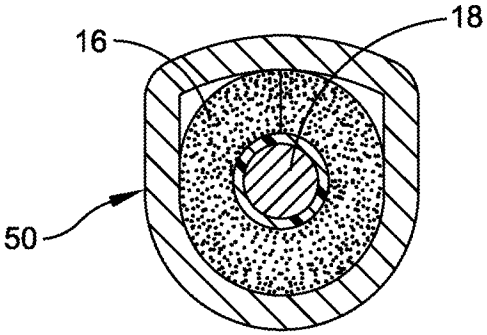
FIG. 2B is a cross-sectional view taken along line 2B-2B of FIG. 2.
Figure 2A:
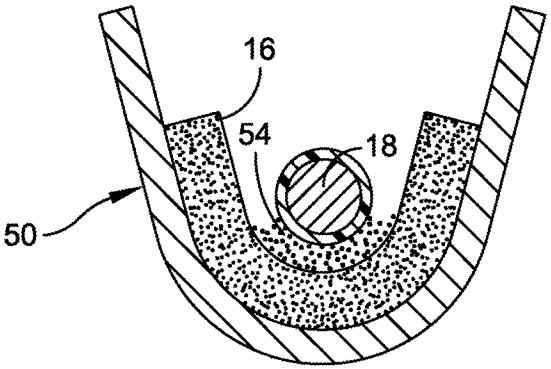
FIG. 2A is a cross-sectional view taken along line 2A-2A of FIG. 2.

The forming tool 44 also includes an outlet portion or member 50 wherein the flat input base 46 is curved into a circular configuration as illustrated by the fragmentary cross-sectional views of FIGS. 2A and 2B.

The perspective view of FIG. 2 also illustrates the wire 18. The wire 18 may be an uncoated metal wire but preferably is a wire with an insulated outer coating. In either case, the wire 18 is shown fed over the guide member 48 into a guide tube 50 so that the wire can have an application of an adhesive applied thereto. The adhesive, in addition to helping to hold the wire 18 in place during manufacturing of the product, also has been found to have cushioning and force absorption attributes due to its resiliency, thus protecting the tracer wire product from damage, to be discussed in detail below. The wire 18 then progresses to the outlet member portion of the forming tool essentially at the center thereof so that the woven material can be folded about the wire. FIG. 2B shows a cross-section where the polyester woven material 16 is about completely wound about the wire where the woven material ends abut each other.

Reference is now made to the cross-sectional view of FIG. 3 which is taken along line 3-3 of FIG. 2. This cross-sectional view illustrates further details of the forming tool; and more particularly, of the hot melt pump system 22. The hot melt pump system may basically be of conventional design, although its application in the process of the present invention is believed to be unique. Thus, in FIG. 3 there is illustrated a head 52 of the hot melt system or gun. FIG. 3 also illustrates the liquid adhesive at 54 being dispensed at an outlet port 55 of the head 52. It is noted that the inlet tube 50 guides the wire to the port 55 where a small amount of adhesive is applied about the entire diameter of the wire. This adhesive will assist at a later stage at the outlet of the forming tool to provide at least a partial retaining of the wire relative to the woven material that is wound thereabout.

Reference is also now made to a sectional view taken at the extruder 28. FIG. 4 also illustrates the guide tube 24 that maintains the product in a substantially circular configuration. The guide tube 24 preferably has an outlet restriction illustrated at 25 in FIG. 4. The tube 24 preferably terminates at a location just upstream of the location where the extruded material is deposited about the product. The extruder 28 may be of conventional design and FIG. 4 illustrates the extruded material at 29 being delivered about the formed product. This thus forms an outer sleeve 60 as illustrated in FIG. 4. The sleeve 60 is preferably disposed about the entire circumference of the product. Details of the extruded material are to be found below in connection with FIG. 2C.

Figure 6:
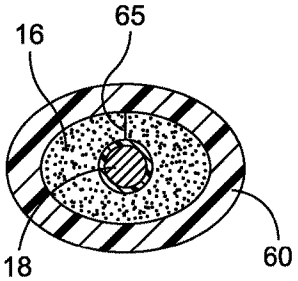
FIG. 6 is a cross-sectional view taken along line 6-6 of FIG. 5 and illustrating the final oval shape of the wire product.
Figure 7:
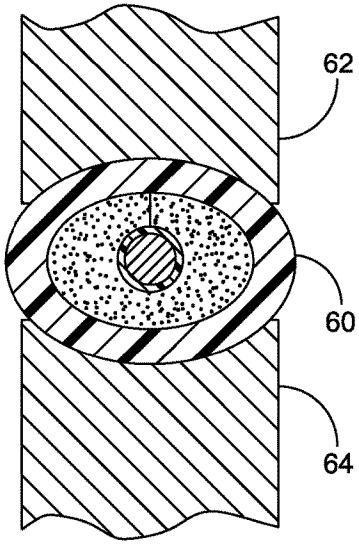
FIG. 7 is a cross-sectional view taken along line 7-7 of FIG. 5.

The shape of the final product is preferably an oval shape as illustrated in the cross-sectional view of FIG. 6. For this purpose and as illustrated previously in the block diagram of FIG. 1, there is provided a forming system or apparatus 32 that may be in the form of two free-wheeling disc-like members 62 and 64. Each of these circular members 62 and 64 may be appropriately supported at their respective centers for free rotation. As the product progresses in the direction of arrow 63, it is pulled through the forming station 32 and the resulting configuration is shown in the cross-sectional view of FIG. 6. FIG. 7 is a further cross-sectional view taken along line 7-7 of FIG. 5 illustrating the configuration of the opposed concave recesses within each of the circular members 62 and 64.

One aspect of the present invention is the particular configuration of the forming tool 44. The diameter at the output section of the tool is controlled so that the diameter has a relationship with the width W of the woven material 16. This may be useful in controlling the folding over step so that the opposed edges of the woven material meet as at the demarcation line 65 illustrated in FIG. 6. In this way, the two side edges of the woven material end up, via the forming operation, abutting each other at the line 65. This prevents any bunching up of any of the materials that are used while at the same time having the center conductor or wire 18 properly positioned within the tracer wire product. The adhesive applied to the wire also assists in maintaining the relative position between the center conductor wire and the woven material. In practice the adhesive may be thinner than illustrated in FIGS. 6 and 7. Moreover, the application of the sleeve soon after the forming operation is instrumental in providing an effective and uniform product.

Figure 2C:
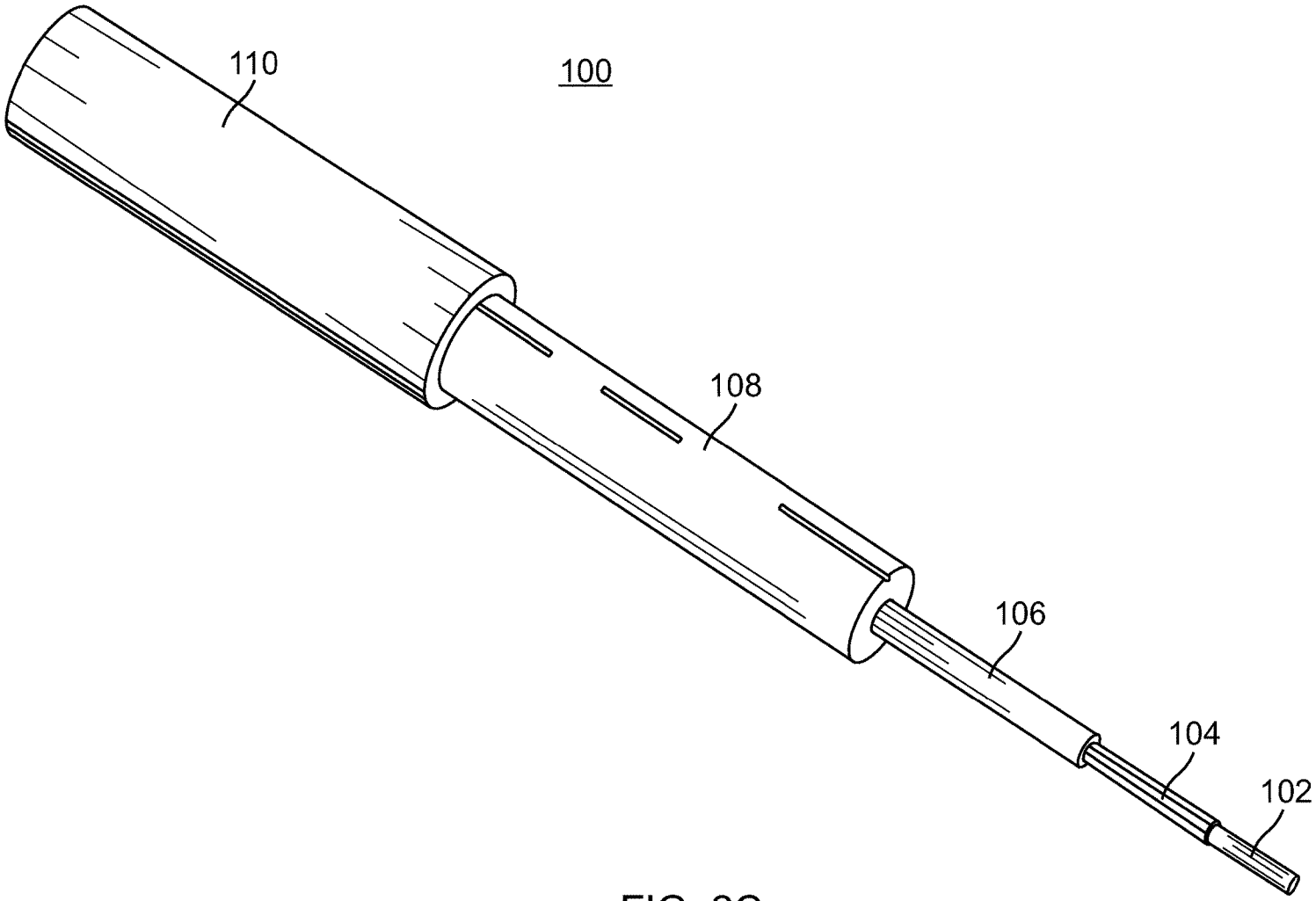
FIG. 2C is a perspective view of the tracer wire product of the present invention.

Turning now to FIG. 2C, this figure illustrates the overall structure of the tracer wire product 100. The tracer wire product is designed to be buried underground and to act as a means of ascertaining the position of underground cables, such as fiber optic cables, underground pipes that may be of a non-metallic material, etc., as described in the aforesaid U.S. Pat. No. 7,932,469, at column 1, line 20 to column 2, line 41.

Tracer wire 100 at its center includes a copper conductor, preferably a copper conductor that is about a 19 AWG solid wire conductor. The characteristics and rationale for such a size conductor (rather than the more usual 12 AWG conductor) are as follows. A 19 AWG conductor provides better performance in a number of ways. First, it has been found that in an industry standard lightning damage test, such as TIA/EIA 455-81-92, that the 19 AWG conductor, when struck by low and high intensity lightning strikes vaporized, leaving no path for electric current to travel down the line and potentially electrocute a person working near the conduit. In instances in which a 10 or 12 AWG was used, it was found that those wires remained intact upon being hit by lightning, with the potential electrocution injuries attendant thereto. Second, it has been found that using 19 AWG provides better signal strength. If a transmitter puts out the same amount of energy on a larger diameter wire as a smaller diameter wire, then relative to the receiver of the energy the smaller conductor will possess a higher signal strength than a larger conductor so that detection is easier. For example, in one test, a tracer wire product made in accordance with the present invention provided a 720 kHz reading whereas a more traditional 12 or 14 AWG wire provided a reading of 415 kHz to 435 kHZ.

Over the conductor 102 tin is plated 104 to provide corrosion resistance. Over tin plating 104 a polyethylene jacket may be formed to provide further protection of the conductor 102. As mentioned above, however, and as illustrated in FIG. 2A as reference numeral 54, a coating of a hot melt material is placed onto and may surround the polyethylene jacket 106. On top of the hot melt material 54 and the jacket 106 is formed a high tenacity woven polyester strength element (element 16 in FIGS. 2A and 2B) having in the vicinity of 1800 lbs. tensile strength and may include water blocking fibers. Finally, an approximately 30 mil abrasion-resistant HDPE outer jacket 110 is formed, completing the structure of the tracer wire product.

Testing which has been done of the above composite structure will now be described. Two tests were made on the tracer product formed: crush testing and needle abrasion testing. These two tests may be useful in determining the likelihood a product will survive in the "real world", that is, the world of cables buried in the earth where they are subject to water invasion, corrosion and may have to survive sometime rough engagement with entrenchment machinery and lateral pulling forces.

The needle abrasion test was performed under EN3475 and AS4373 Method 701, in which an abrasion needle with a 1500 gram loading force was scratched against the outer coating of the tracer wire product made in accordance with the present invention until the conductor was exposed. The finding was that the present invention structure took nearly twice as many cycles to abrade through the insulation than the next best 12 AWG wire and was over 12 times better than the worst 12 AWG wire. Thus abrasion resistance appears to be very good, if not excellent.

The crush testing of the tracer wire product of the present invention was performed under the requirements of UL1581, Section 985 for "CRUSHING RESISTANCE". While the UL testing method does not test to the point that causes failure, which may be described as the point at which the fixture comes into contact with the copper conductor, the material of the present invention was tested to that extent. As a result, it was found that the tracer wire product made in accordance with the present invention has as much as 10 times crushing resistance than that of 12 AWG. The product was found to distribute the force more evenly across the cable width. As shown in FIG. 6, it has been found that using a round or preferably oval shape contributes to the strength of the tracer wire product.

In addition, tensile testing of the tracer wire product of the present invention was done. The tests determined that the tensile strength of the wire of the present invention to be about ten times as strong as ordinary 12 AWG copper wire. This was due, it is submitted, to the polyester fibers which take the majority of the tensile load during the testing.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A detectable tracer element for use in detection of underground utility line or routes comprising:

a metallic wire configured to conduct an electrical signal for detection by an aboveground signal detector wherein the metallic wire is copper-based and has a size of about 19AWG;

a tin coating formed over the metallic wire;

a non-fibrous insulating jacket of polyethylene over the metallic wire and the tin coating;

a layer of hot melt adhesive at least partially over the polyethylene jacket;

a high tenacity woven polyester strength element with water blocking fibers being formed over the hot melt adhesive and the polyethylene jacket and having a tensile strength of about 1800 lbs.;

an abrasion resistant HDPE outer jacket formed over the high tenacity woven polyester strength element to form an oval cross-sectional shape; and wherein the non-fibrous polyethylene jacket is about 0.005" in thickness and the HDPE jacket is about 0.030" in thickness.

2. The detectable tracer element of claim 1 wherein the hot melt adhesive is comprised of one or more of: ethylene vinyl acetate copolymer; pentaerythratol rosin ester; C9/C5 hydrocarbon tackifying resin and an antioxidant.

3. The detectable tracer element of claim 1, wherein the tracer element as configured passes the requirements of one or more of: UL1581, Section 985 crushing resistance and a needle abrasion test under EN 3475 and AS 4373 Method 701.

* * * * *